United States Patent [19]

Eibe

[11] Patent Number: 4,553,297

[45] Date of Patent: Nov. 19, 1985

[54] HYDRO-MECHANICAL INFLATABLE CROWN ROLL

[75] Inventor: Werner W. Eibe, Pittsburgh, Pa.

[73] Assignee: White Consolidated Industries, Inc., Cleveland, Ohio

[21] Appl. No.: 594,798

[22] Filed: Mar. 29, 1984

[51] Int. Cl.[4] ..... B21B 13/02

[52] U.S. Cl. ..... 29/113 AD; 100/162 B

[58] Field of Search ..... 29/116 AD, 116 R, 113 AD, 29/113 R, 110, 148.4 D, 125; 100/162 B

[56] References Cited

U.S. PATENT DOCUMENTS

| | | | |
|---|---|---|---|
| 2,614,952 | 10/1952 | Kraft | 29/113 R X |
| 2,651,241 | 9/1953 | Hornbostel | 29/148.4 D |
| 2,956,826 | 10/1960 | Nord | 29/148.4 D X |
| 3,094,771 | 6/1963 | Robertson | 29/116 AD |
| 4,062,096 | 12/1977 | Eibe | 29/113 AD |
| 4,194,446 | 5/1980 | Palovaara | 100/162 B |

FOREIGN PATENT DOCUMENTS

| | | | |
|---|---|---|---|
| 1111987 | 3/1956 | France | 29/426 |

*Primary Examiner*—Howard N. Goldberg
*Assistant Examiner*—John T. Burtch
*Attorney, Agent, or Firm*—Walter J. Blenko, Jr.; Arnold B. Silverman

[57] ABSTRACT

The cavity or gap between shell and arbor of a hydraulically inflatable roll also houses metal support elements which may be adjusted to fill that gap partially or wholly. The roll support elements are mating wedges, preferably a pair of sawtooth profiled metal ring assemblies with inclined faces bearing on each other. The degree of support is varied by moving one assembly axially on the other. Hydraulic apparatus for so moving an assembly is contained with the roll arbor.

11 Claims, 5 Drawing Figures

HYDRO-MECHANICAL INFLATABLE CROWN ROLL

BACKGROUND OF THE INVENTION

Mills for rolling metal strip must have some provision for crowning the rolls in order to produce flat strip. Roll bending devices are widely used for that purpose as they can be adjusted to vary the roll crown. They are, however, expensive and cumbersome. Hydraulically inflated variable crown rolls have therefore been developed, such as the roll of Eibe U.S. Pat. No. 4,062,096, in which the roll crown is varied by increasing or decreasing the pressure at which the hydraulic fluid is injected between the roll arbor and its shell. Rolls so constructed have prooved satisfactory for many low and medium duty rolling operations. Hydraulic oil, however, is about 100 times softer than steel and under high external loading conditions, such as obtain in heavy duty rolling operations, a certain amount of crown collapse must be expected. The existing hydraulically inflatable crown rolls, sometimes called "soft" rolls, do not have enough operational crowning capability to withstand the heaviest rolling conditions.

SUMMARY OF THE INVENTION

The principal object of this invention is to provide a variable crown type roll which makes a metal-to-metal contact between arbor and shell throughout a considerable crowning range. Another object is to provide a roll of variable stiffness modulus. Still another object is to provide a hydraulically inflatable roll with metal supporting elements which by their contour determine the loaded operating crown of the roll. These and other objects, which will appear in the description of my invention which follows, are attained by a roll construction in which the cavity or gap between arbor and shell of a hydraulically inflatable roll houses metal support elements which may be adjusted to fill that gap partially or wholly. The roll support elements are mating wedges, preferably a pair of sawtooth profiled metal ring assemblies with inclined faces bearing on each other. The degree of support is varied by moving one assembly axially on the other. Hydraulic apparatus for so moving an assembly is contained within the roll arbor.

DESCRIPTION OF PREFERRED EMBODIMENTS

Figure 1:
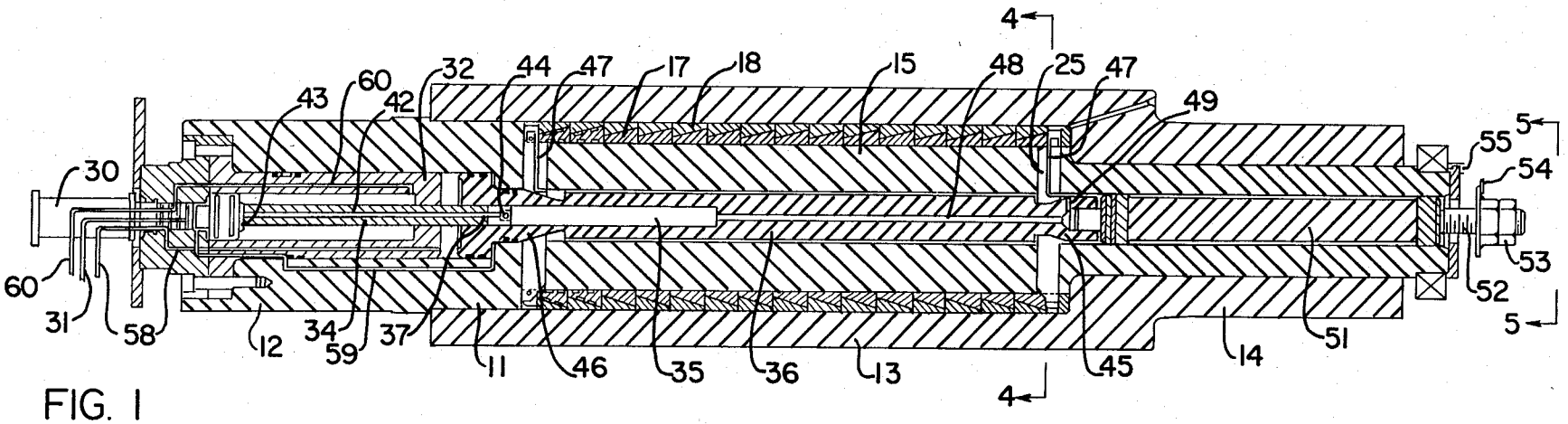
FIG. 1 is an axial section through a roll of my invention showing the basic roll construction.

My roll as is shown in FIG. 1 comprises an arbor 11 having a roll neck 12 at one end and a shell 13 fitting over arbor 11 and extending into a roll neck 14 at the other end of the roll. The center portion 15 of arbor 11 is of reduced diameter so as to leave an annular cavity

Figure 2:
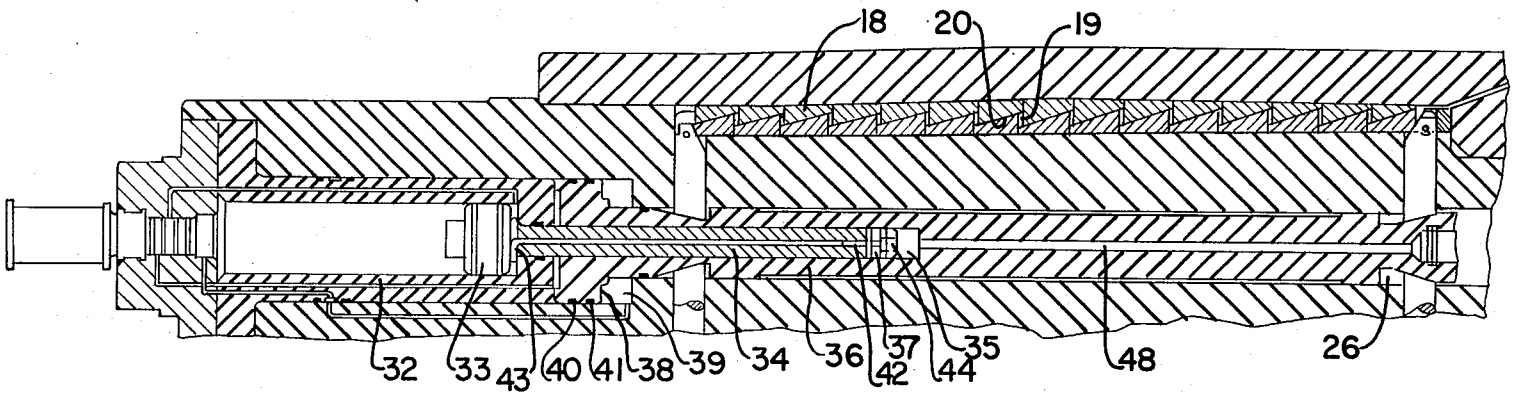
FIG. 2 is a partial axial section through the roll of FIG. 1 but showing the roll fully inflated hydraulically and fully supported mechanically.
Figure 3:
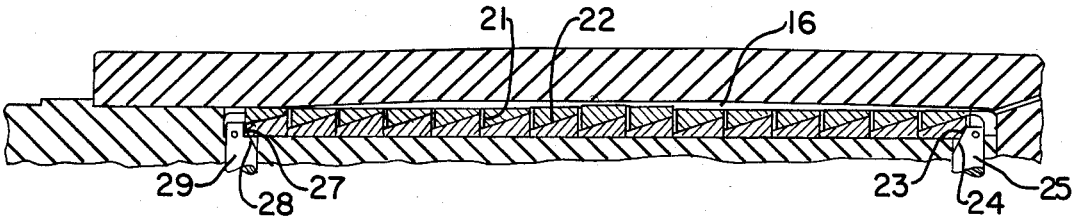
FIG. 3 is an axial section through a portion of the roll of FIG. 1 showing the roll fully inflated hydraulically but only half supported mechanically.

16 between arbor 11 and shell 13. Cavity 16 is best shown in FIG. 3, where a portion of it is filled only with hydraulic fluid. Cavity 16 also contains cooperating support elements 17 and 18, the first-mentioned being seated on portion 15 of arbor 11 and the second mentioned being shown in FIG. 2 as seated against the underside of shell 13. The cooperating faces of support elements 17 and 18 have complementary sawtooth contours or profiles and the support elements are each conveniently formed as a series of separate metal rings. The rings may be split rings. As may be seen in FIG. 2 each ring of support element 17 has an end face 19 normal to the roll axis and a face 20 inclined to face 19. As may be seen in FIG. 3 each ring of support element 18 also has an end face 21 normal to the roll axis and a face 22 inclined to face 21. The angles of inclination of cooperating faces 20 and 22 of mating pairs of rings are identical, but, the angles of inclination of successive pairs of rings may decrease from the axial center of the roll toward both roll necks, as will be described hereinafter.

Figure 4:
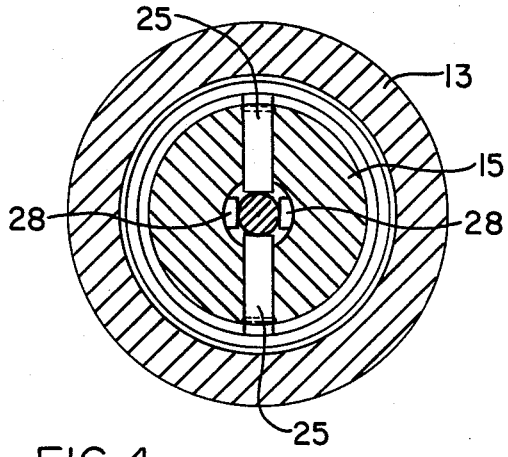
FIG. 4 is a radial cross-section through the roll of FIG. 1 taken on plane 4—4 thereof.

My roll includes mechanism for shifting one support element axially with respect to the other, thus increasing or decreasing the radial dimension of the portion of cavity 16 occupied by support elements 17 and 18. I prefer to shift support element 17 and fix support element 18 in place. As is seen in FIG. 3 the outermost end face 21 of the end ring of support element 17 is beveled at 23. Bevel 23 rests against bevel 24 of wedge 25 which can be moved radially in center portion 15 of my roll. Movement outwardly of wedge 25 causes support element 17 to move against support element 18 so as to increase their combined radial dimension. At the other end of support element 17 the outermost face of the end ring is beveled at 27 and that bevel rests against bevel 28 of wedge 29 which also can be moved radially in center portion 15. Movement outwardly of wedge 29 causes support element 17 to move away from support element 18 so as to decrease their combined radial dimension. Wedges 25 and 28 are shown in the same plane in FIGS. 1, 2 and 3 but as is shown in FIG. 4, I find it desirable to position them normal to each other.

The wedges 25 and 28 are hydraulically operated. Hydraulically inflated variable crown rolls require higher inflating pressure than can be readily handled by conventional rotating joints. My roll is supplied with hydraulic fluid from an outside source at a pressure on the order of 2,000 psi through a rotary joint 30. A duct 31 in rotary joint 30 opens into a low pressure cylinder 32. In cylinder 32 is fitted a piston 33 on a piston rod 34 which passes through the otherwise closed end of cylinder 32 and through piston 38 to be described hereinafter into a high pressure cylinder 35 in a member 36 which can move axially in a bore 26. The ratio of the area of the low pressure piston 33 to that of the high pressure piston 37 on piston rod 34 is about 5 to 1 so that the pressure in high pressure cylinder 35 is about 10,000 psi.

Piston rod 34 is formed with an axial bore 42 which extends from piston 37 through cross bore 43 at the piston rod end of piston 33 into cylinder 32. At its end in piston 37 bore 42 is fitted with a check valve 44 which opposes entrance of fluid from cylinder 35 into bore 42.

Member 36 is cylindrical and extends axially entirely through center portion 15 of arbor 11. Its end adjoining roll neck 12 carries piston 38 movable in short cylinder 39 which is coaxial with cylinder 32 but of larger diameter. Near its end adjacent cylinder 32 piston 38 carries a pressure seal 40 and near its rod end it carries a second pressure seal 41, the seals being arranged so that each opposes higher differential pressure originating outside its own end of piston 38. The portions 45 and 46 of member 36 at the inside ends of wedges 25 and 28 respectively are frusto-conical in shape, oppositely disposed, so that movement of member 36 in one direction causes wedges 25 to move radially outwardly and allows wedges 28 to retract, thus moving support element 17 in the same direction as member 36, and movement of member 36 in the opposite direction causes wedges 28 to move radially outwardly and allows wedges 25 to retract, moving support element 17 along with member 36.

Figure 5:
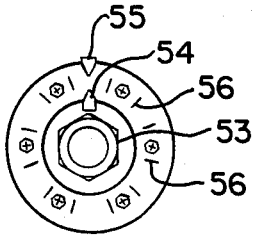
FIG. 5 is an end view of the roll of FIG. 1 taken on the plane 5—5 thereof.

The length of member 36 between the inside ends of frusto-conical portions 45 and 46 is necessarily less than the length of bore 26. That bore communicates with cross bores 47 which extend lengthwise through wedges 25 and 28 into cavity 16. An axial bore 48 extends through member 36 from the inside end of cylinder 35 to a cross bore 49 in frusto-conical portion 45 which opens into bore 26. The outer end of that portion 45 is mechanically connected to an extension 51 which extends through a bore in roll neck 14, which may be a prolongation of bore 26, beyond the end of roll neck 14 as threaded portion 52. That portion carries a nut 53 to which is affixed a pointer 54. On the end of roll neck 14 is fixed an indexing marker 55, and, if desired, intermediate angularly spaced markings 56, shown in FIG. 5.

In roll neck 12 a bore 31 from rotary joint 30 extends into the outside end of cylinder 32 and a bore 59 connects bore 31 with the inside end of cylinder 39. A bore 58 from rotary joint 30 extends through the inside end of cylinder 32 into cylinder 39 at its outside end. A third bore 60 extends from rotary joint 30 into the inside end of cylinder 32. My rotary joint 30 is connected by valve means and fluid lines not shown to a source of hydraulic fluid at a pressure of about 2,000 psi. When that fluid is admitted through duct 31 into cylinder 32, intensifier piston 33 is forced from its position shown in FIG. 1 to its position shown in FIG. 2. Piston 33 moves piston rod 34 in the smaller cylinder 35 in the same direction so that piston 37 in that cylinder compresses fluid to a high pressure, on the order of 10,000 psi, previously mentioned. That compressed fluid flows through bore 48 and cross bore 49 into annular cavity 16. Some fluid may also flow through the clearance between member 36 and arbor portion 15 and out through cross bore 47 into cavity 16 at its other end. The pressure of that fluid inflates shell 13, thus crowning my roll.

Wedge support elements 17 and 18 are operated by the low pressure fluid supplied to duct 31. When that fluid is allowed to enter bore 59 it flows into cylinder 39 forcing piston 38 toward cylinder 32. Member 36 attached to piston 38 moves in the same direction and its frusto-conical portion 45 causes wedges 25 to move radially outwardly. The beveled outer face 24 of wedges 25 moving against beveled end face 23 of support element 17 causes that element to move toward roll neck 12, and mating support element 18 to move radially outwardly, thus reducing the volume of annular cavity 16 and increasing the stiffness or hardness of the crown. The degree of that support depends on the length of the stroke of member 36. That stroke length is limited by nut 53 previously described. As nut 53 is screwed down on threaded portion 52 of element extension 51 the length of stroke of member 36 is reduced. Fine adjustment of that stroke is made possible by pointer 54 carried by nut 53 and indexing marker 55 affixed to the outside end of my roll.

The mechanical support provided by members 17 and 18 is reduced by causing member 36 to move toward roll neck 14, thus allowing wedges 25 to retract and causing frusto-conical portion 46 of member 36 to force wedges 29 radially outwardly with their beveled outer ends 28 bearing against beveled ends 27 of support element 17. In that way support element 17 is moved toward roll neck 14, reducing the radial dimension of combined support elements 17 and 18. This support collapse is brought about by admitting low pressure hydraulic fluid into bore 58 and allowing the hydraulic fluid to drain from bore 59.

The inflation of the roll by high pressure hydraulic fluid is reduced by admitting low pressure hydraulic fluid through bore 60 to the inside end of cylinder 32 and allowing that fluid to drain from the outside end of that cylinder, thus causing intensifier piston 37 to retract.

The valve means controlling the operations abovementioned are located outside my roll. Those means, the connection between them and my roll and the source of hydraulic fluid are conventional and are not shown.

The contour of my fully inflated, fully supported roll is predetermined by the graduation of the angles of inclination of successive pairs of the rings of support elements 17 and 18 from roll center to roll end as I have mentioned. That contour may be flattened without loss of stiffness by partially disengaging support elements 17 and 18 and reducing the inflating pressure until shell 13 rests on the support elements. If desired, the stiffness of my roll may be reduced without change of contour by partially disengaging support elements 17 and 18 without reducing inflating pressure.

In the foregoing specification I have described a presently preferred embodiment of my invention; however, it will be understood that my invention can be otherwise embodied within the scope of the following claims.

I claim:

1. A hydro-mechanical inflatable crown rolling mill roll comprising an arbor, a cylindrical shell thereon, an annular cavity between said arbor and said shell, means carried by said arbor for introducing hydraulic fluid under pressure into said cavity to crown said shell, mechanical means positioned in said cavity and movable radially outwardly to increase and decrease the effective diameter of said mechanical means, and actuating means carried by said arbor effective to shift said mechanical means after inflation of the sleeve to an extent sufficient to provide clearance between the mechanical means and the shell, whereby the crown and the stiffness of the roll are varied by adjusting said hydraulic pressure and the radial position of said mechanical means.

2. The roll of claim 1 in which said mechanical means comprise elongated complementary wedge members having their inclined faces seated against each other, and said actuating means are disposed to move said wedged members axially with respect to each other, thereby causing them to vary the crowning of said roll.

3. The roll of claim 2 in which the elongated complementary wedges comprise sawtooth profiled members.

4. The roll of claim 3 in which the sawtooth face angles of said elongated complementary wedge members are maximum at the axial center of the roll and decrease gradually toward each end of the roll.

5. The roll of claim 3 in which the sawtooth profiled wedge members comprise a plurality of separate rings.

6. The roll of claim 2 in which one of said complementary wedge members is fixed axially of the roll and the actuating means are adjusted to move the other complementary wedge member axially of the roll.

7. The roll of claim 2 in which the actuating means for said complementary wedge members extend axially through the arbor and project beyond one end thereof, and including adjustable stop means on said projecting end.

8. The roll of claim 7 including radial wedge members positioned in said roll at the ends of said complementary wedge members, bevels on both ends of said radial wedge members, bevels on both ends of one complementary wedge member mating with said bevels on the ends of said radial wedges, and frusto-conical sections on said actuating means for said complementary wedge members mating with said bevels on the inside ends of said radial wedge members, whereby axial movement of said actuating means causes radial movement of said wedges and said radial movement causes axial movement of said complementary wedge member.

9. The roll of claim 1 in which the means for introducing hydraulic fluid under pressure into said cavity comprise a pressure intensifier and the actuating means for said mechanical means comprise a hydraulic cylinder hydraulically connected with the low pressure cylinder of said pressure intensifier.

10. The roll of claim 9 in which the low pressure cylinder of said pressure intensifier is positioned in one roll neck, the high pressure cylinder of said intensifier is co-axial with said low pressure cylinder but spaced therefrom, the cylinder of said actuating means is intermediate said low pressure and said high pressure cylinders and co-axial therewith, and the piston rod of said pressure intensifier passes through said cylinder of said actuating means.

11. The roll of claim 9 in which the high pressure cylinder of said pressure intensifier is positioned in the piston rod of said hydraulic cylinder of said actuating means.

* * * * *